US007339312B2

(12) United States Patent
Yamada et al.

(10) Patent No.: US 7,339,312 B2
(45) Date of Patent: Mar. 4, 2008

(54) GAS DISCHARGE TUBE AND DISPLAY DEVICE HAVING A PROTRUSION HAVING A SURFACE FACING TOWARDS DISPLAY SURFACE

(75) Inventors: Hitoshi Yamada, Kawasaki (JP); Akira Tokai, Kawasaki (JP); Kenji Awamoto, Kawasaki (JP)

(73) Assignee: Shinoda Plasma Corporation, Akashi (JP)

( * ) Notice: Subject to any disclaimer, the term of this patent is extended or adjusted under 35 U.S.C. 154(b) by 271 days.

(21) Appl. No.: 11/064,950

(22) Filed: Feb. 25, 2005

(65) Prior Publication Data

US 2006/0103292 A1 May 18, 2006

(30) Foreign Application Priority Data

Nov. 15, 2004 (JP) ..... 2004-329991

(51) Int. Cl.
*H01J 1/62* (2006.01)

(52) U.S. Cl. ..... 313/485; 313/234; 313/607

(58) Field of Classification Search ..... 313/607, 313/594, 234, 485–487
See application file for complete search history.

(56) References Cited

U.S. PATENT DOCUMENTS 6,577,060 B2 6/2003 Tokai et al.
6,677,704 B2 1/2004 Ishimoto et al.

FOREIGN PATENT DOCUMENTS

JP 2001-265256 9/2001
JP 2003-68214 3/2003

*Primary Examiner*—Joseph Williams
*Assistant Examiner*—Bumsuk Won
(74) *Attorney, Agent, or Firm*—Staas & Halsey LLP

(57) ABSTRACT

A gas discharge tube includes a thin tube having a discharge space therein and an electron emissive coating formed within the thin tube. The thin tube has a display surface on which a pair of display electrodes is adapted to be disposed, and has a rear surface on which a signal electrode is adapted to be disposed. A surface portion facing toward the display surface is formed within the thin tube at a location nearer to the display surface from the midway between the display and rear surfaces. An electron emissive coating is formed on the surface portion. Thus the gas discharge tube can reduce its firing voltage without lowering the light-emission efficiency.

14 Claims, 9 Drawing Sheets

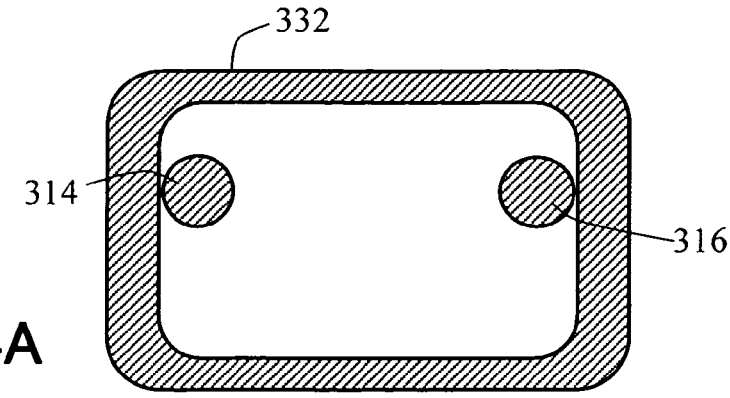
FIG. 14A
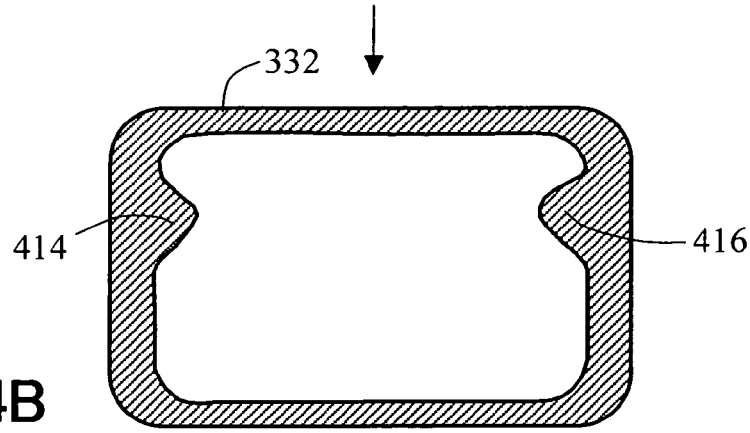
FIG. 14B
FIG. 14C
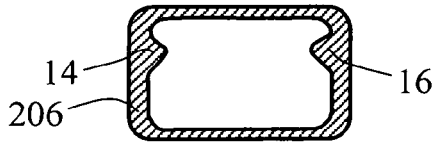
FIG. 14D
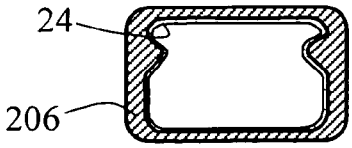
FIG. 14E
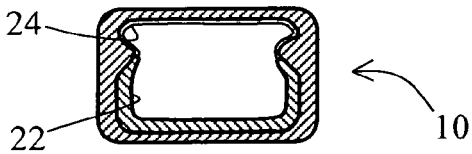

GAS DISCHARGE TUBE AND DISPLAY DEVICE HAVING A PROTRUSION HAVING A SURFACE FACING TOWARDS DISPLAY SURFACE

FIELD OF THE INVENTION

The present invention relates generally to a gas discharge tube and, more particularly, to a thin, tubular gas discharge tube suitable for use in a display device.

BACKGROUND OF THE INVENTION

It is possible to employ a lower firing voltage for a tubular gas discharge tube by using a thin tube having a circular cross-section, a flattened-circular or race-track shaped cross-section, or a rectangular cross-section, and forming, on the inner wall of the thin tube, a protection coating having a high electron emitting coefficient. A tubular gas discharge tube without a protection coating cannot be fired with a voltage of, for example, 500 V, but it can be fired with a lower voltage of, for example, 350 V and driven with a lower voltage if a protection coating is formed on the inner wall of the tube.

In Japanese Patent Application Publication No. 2001-265256 A published on Sep. 28, 2001, which corresponds to U.S. Pat. No. 6,577,060 B, Tokai et al. disclose a display device having a screen formed of a substrate and a group of elongated light-emitters arranged on the substrate. On at least one lateral side of each light-emitter, an elongated electrode support with a plurality of electrodes arranged along the length direction of the light-emitter is disposed. A conductor pattern is formed on the substrate for supplying electricity to the electrodes on the electrode supports. Light-emission from the light-emitters is controlled by means of the conductor pattern and the plural electrodes.

In Japanese Patent Application Publication No. 2003-68214 A published on Mar. 7, 2003, which corresponds to U.S. Pat. No. 6,677,704 B, Ishimoto et al. disclose a gas discharge display device, which includes a support, a plurality of thin discharge tubes with a phosphor layer therein, disposed in parallel side by side on the support, and signal electrodes disposed in contact with the outer surfaces of respective ones of the thin discharge tubes and extending in the length direction along the thin discharge tubes. The display device further includes a plurality of display electrode pairs each consisting of a scan electrode and a common electrode alternately disposed in contact with the outer surfaces of the respective discharge tubes opposite to the surfaces on which the signal electrodes are disposed. The display electrodes extend transverse to the thin discharge tubes. The thin discharge tube has a flattened-elliptic cross-section, with two flat opposing outer surfaces. The signal electrodes are disposed to contact one of the flat outer surfaces. Pairs of scan and common electrodes disposed close to each other are disposed on the other flat surface. One of the flat outer surfaces is supported by the support.

SUMMARY OF THE INVENTION

In accordance with an aspect of the present invention, a gas discharge tube includes a thin tube having a discharge space therein and an electron emissive coating formed within the thin tube. The thin tube has a display surface on which a pair of display electrodes is adapted to be disposed, and has a rear surface on which a signal electrode is adapted to be disposed. A surface portion facing toward the display surface is formed within the thin tube at a location nearer to the display surface from the midway between the display and rear surfaces. An electron emissive coating is formed on the surface portion.

In accordance with another aspect of the invention, a gas discharge tube includes a thin tube having a discharge space therein and an electron emissive coating formed within the thin tube. The thin tube has a display surface on which a pair of display electrodes is adapted to be disposed, and has a rear surface on which a signal electrode is adapted to be disposed. A protrusion is formed to protrude from a portion of an inner wall of the thin tube toward the discharge space. The protrusion has a surface portion facing toward the display surface. An electron emissive coating is formed on the surface portion.

In accordance with a further aspect of the invention, a gas discharge tube includes a thin tube having a discharge space therein and an electron emissive coating formed within the thin tube. The thin tube has a display surface on which a pair of display electrodes is adapted to be disposed. The thin tube has a protrusion protruding from a portion of an inner wall of the thin tube toward the discharge space and having a surface portion facing toward the display surface, and has a groove formed in an outer surface of the thin tube and generally conformable with the protrusion. An electron emissive coating is formed on the surface portion. A signal electrode is adapted to be formed on a surface portion of the groove corresponding to the surface portion of the protrusion.

In accordance with a still further aspect of the invention, a gas discharge tube includes a thin tube having a discharge space therein, and an electron emissive coating and a phosphor layer disposed within the thin tube. The thin tube has a display surface on which a pair of display electrodes is adapted to be disposed, and has a rear surface on which a signal electrode is adapted to be disposed. The phosphor layer is formed on a support member separate from the thin tube. The support member is inserted into the thin tube to locate in the discharge space. The support member has an end surface facing toward the display surface of the thin tube. An electron emissive coating is formed on the end surface of the support member.

In accordance with a still further aspect of the invention, a display device includes a gas discharge tube array including a plurality of gas discharge tubes as described above arranged in parallel side by side, and a pair of supports respectively disposed on a display surface side and a rear surface side of the gas discharge tube array to sandwich the gas discharge tube array. One of the supports bears a plurality of such pairs of display electrodes on a surface of the one support that faces the gas discharge tube array. The other one of the supports bears a plurality of such signal electrodes on a surface of the other support that faces the gas discharge tube array.

BRIEF DESCRIPTION OF THE DRAWINGS

FIGS. 14A through 14E show illustrate a process for manufacturing the gas discharge tube shown in FIG. 1;

DESCRIPTION OF THE PREFERRED EMBODIMENTS

Figure 1:
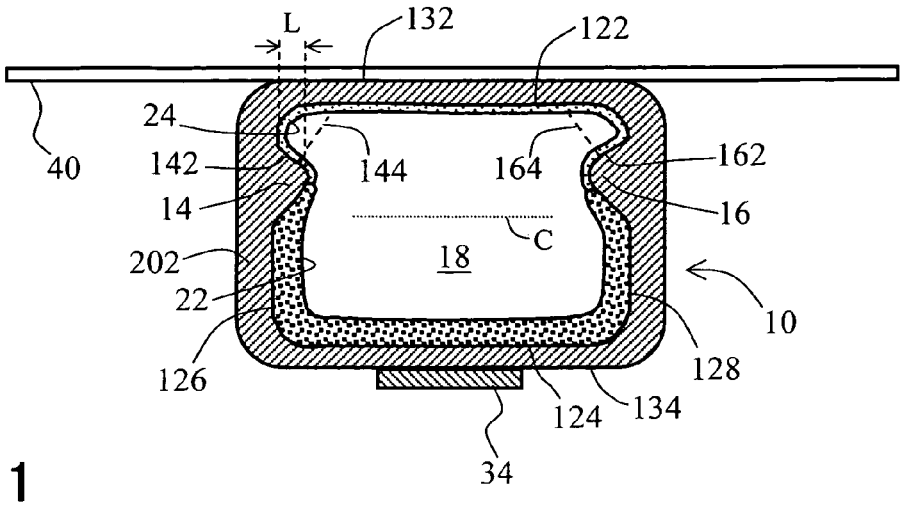
FIG. 1 shows a transverse cross-section of an elongated gas discharge tube in accordance with an embodiment of the present invention.

According to a conventional technique, in order to realize a lower firing voltage of a gas discharge tube, a pressure of a gas filling the discharge tube is reduced from a commonly employed pressure of, for example, 0.5 atmospheres, to 0.3 atmospheres. However, this increases a mean free path length of charged seeds or charged particles, which accelerates sputtering of a protection coating, resulting in decrease of the life time of the gas discharge tube. The decrease of the gas pressure also reduces the amount of ultraviolet radiation or the amount of vacuum ultraviolet light, causing reduction of the brightness of phosphor layers, resulting in decrease of light-emission efficiency. The lowering of the firing voltage of a gas discharge tube can be realized also by decreasing the distance between a pair of electrodes which cause discharge to occur, but it reduces the light-emission efficiency because of tradeoff usually seen between the electrode distance and the light-emission efficiency. A gas discharge tube with high withstanding voltage power devices may be employed so that it can be driven from a high voltage. However, as long as a high voltage is applied, shortening of the life time of the power devices is inevitable. Further, the use of high withstanding voltage power devices increases the cost of discharge tubes.

The inventors have recognized the need for a gas discharge tube structure that can decrease the firing voltage of a gas discharge tube without reducing its light-emission efficiency.

An object of the present invention is to provide a gas discharge tube having its firing voltage reduced without lowering the light-emission efficiency.

According to the invention, a gas discharge tube can reduce its firing voltage without lowering the light-emission efficiency.

The embodiments of the present invention are now described with reference to the accompanying drawings. It should be noted that, throughout the drawings, the same reference numerals are used for the same or similar elements.

FIG. 1 shows a transverse cross-section of an elongated gas discharge tube 10 in accordance with an embodiment of the present invention. The gas discharge tube 10 includes an elongated, thin tube 202 of a transparent insulating material, e.g. borosilicate glass, and an internal space or cavity 18 is formed within the thin tube 202, in which discharge takes place. The gas discharge tube 10 typically has an outer diameter of about 2 mm or smaller and a length of about 300 mm or larger, and has a generally rectangular or oblong cross-section. An elongated film-like main or display electrode 40 is disposed on an outer display surface 132 on the front side of the discharge tube 10. An elongated film-like signal or address electrode 34 is disposed on the opposite, rear surface 134.

The gas discharge tube 10, in its transverse cross section, exhibits generally bilateral symmetry. Left and right inner surfaces 126 and 128 have narrow ridges 14 and 16 formed therein, respectively. The ridges 14 and 16 extend along the longitudinal direction of the display tube 10 and protrude inward from the inner surfaces 126 and 128. The ridges 14 and 16 are on that side of the horizontal center line C, indicated by a dotted line, which is closer to the main electrode 40 or the display surface 132. The height L of the ridges 14 and 16 is from 2% to 20% of the distance between the left and right inner surfaces 126 and 128. The method of producing the thin tube 202 is described in US2003/0182967 A1 published on Oct. 2, 2003, corresponding to Japanese Patent Application Publication No. 2003-286043 A published on Oct. 7, 2003, which is incorporated herein by reference. As a protecting coating, a secondary electron emissive coating 24 having a thickness of from 200 nm to 900 nm is formed to cover the upward facing inner surface 142, including the top of the ridge 14, the upper inner surface 122, and the upward facing inner surface 162, including the top of the ridge 16, of the thin tube 202. The electron emissive coating 24 has a high secondary emission coefficient, which is a coefficient indicating how many charged particles can be emitted as a result of bombardment by charged particles having energy above a predetermined level. The secondary electron emissive coating 24 may be of, for example, MgO or $Al_2O_3$, and deposited by vacuum evaporation or any other suitable technique. A phosphor layer 22 typically having a thickness of from 5 μm to 30 μm is formed to cover the left inner side surface 126 below the top of the ridge 14, the lower inner surface 124, and the right inner side surface 128 below the top of the ridge 16, of the thin tube 202. The internal space 18 of the gas discharge tube 10 is filled with a discharging gas, and the tube 10 is sealed at its opposite ends.

In FIG. 1, the surface 142 of the left ridge 14 faces toward the display surface 132 or the upper inner surface 122 so that the normal 144 to the surface 142 intersects the upper inner surface 122. Also, the surface 162 of the right ridge 16 faces toward the display surface 132 or the upper inner surface 122 so that the normal 164 to the surface 162 intersects the upper inner surface 122. The surfaces 142 and 162 are spaced from the upper inner surface 122 by a distance within a range of from 5% to 15%, e.g. 10%, of the distance between the upper and lower inner surfaces 122 and 124. The distance may be, for example, 100 μm or smaller, e.g. 80 μm. The normals 144 and 164 intersect the display surface 132 or the inner surface 122 preferably at an angle of from about 30 degrees to about 90 degrees, to thereby increase the probability of secondary electrons being generated by short-distance bombardment of the electron emissive coating 24 on the surfaces 142 and 162 by charged particles produced in regions of the internal space 18 near the main electrode 40 by an applied field.

Figure 2:
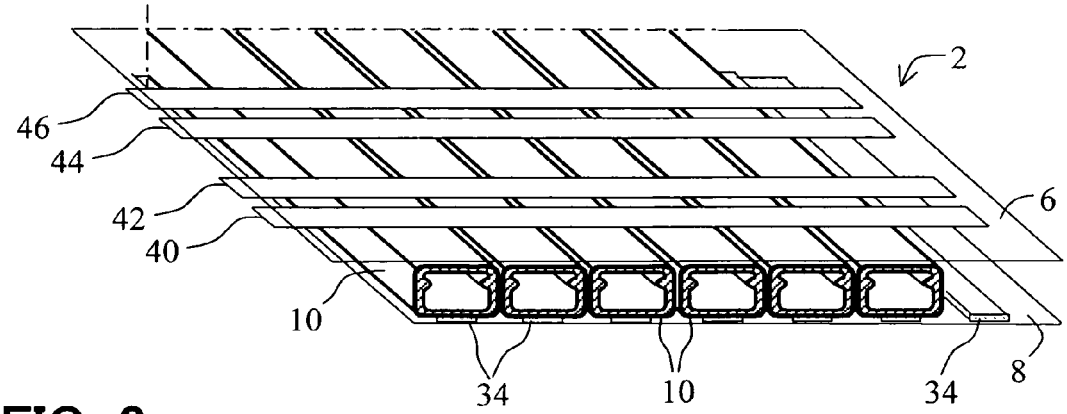
FIG. 2 shows a part of an array of gas discharge tubes arranged in parallel to each other side by side to form a display device.

FIG. 2 shows a part of an array of gas discharge tubes 10 arranged in parallel to each other side by side to form a display device 2. A pair of mutually facing supports 6 and 8 are disposed to sandwich the gas discharge tube array, with the display surfaces 132 of the tubes 10 (FIG. 1) contacting the support 6 and with the rear surfaces 134 (FIG. 1) contacting the support 8. The support 6 supporting the display surfaces 132 is a transparent, flat or curved plate, and the support 8 supporting the rear surfaces 134 is a transparent or black, flat or curved plate. The support 8 may be a combination of a transparent plate with a black coating disposed on the rear surface of the transparent plate. A plurality of signal electrodes 34 are disposed between and in contact with the rear surfaces 134 of the gas discharged tubes 10 and the support 8, one for each gas discharge tube 10, to extend along the length direction of the gas discharge tubes 10. The rear surfaces 134 of the discharge tubes 10 arranged in an array may be sometimes referred to as the rear surface of the display device, hereinafter. A plurality of main electrodes 40, 42, 44 and 46 are disposed between and in contact with the display surfaces 132 of the discharge tubes 10 and the support 6. The display surfaces 132 of the discharge tubes 10 arranged in an array may be sometimes referred to as the display surface of the display device hereinafter. The electrodes 40, 42, 44 and 46 extend in the direction perpendicular to the direction in which the signal electrode 34 extend, and are spaced from each other at respective predetermined distances. The main electrodes 40 and 42 form an electrode pair, and the main electrodes 44 and 46 form another electrode pair. The intersection of the main electrode pair 40, 42 and each signal electrode 34, and the intersection of the main electrode pair 44, 46 and each signal electrode 34 provide respective different unit light-emitting regions or cells. A spacing is disposed between the main electrode 42 of one electrode pair and the adjacent main electrode 44 of the other electrode pair to prevent discharging from occurring between them.

In the arrangement shown in FIG. 2, one electrode of the pair of electrodes 40 and 42, e.g. the electrode 40, is used as a scanning electrode. An addressing or selecting discharge is generated at the intersection of the scanning electrode 40 and the signal electrode 34 to select a light-emitting region. Light emission caused by the addressing discharge forms a wall charge on the inner surface 122 in the selected region (FIG. 1). The wall charge is used to produce display discharge between the main electrodes 40 and 42 forming a pair by applying a sustain voltage between the pair of main electrodes 40 and 42. The selecting discharge is a "vertical opposite discharge" generated in the inner space 18 (FIG. 1) of the gas discharge tube 10 between the scanning electrode 40 and the signal electrode 34 facing the scanning electrode 40, whereas the display discharge is a surface discharge generated on the inner surface 122 beneath the spacing between the two main electrodes 40 and 42 disposed in parallel with each other in a plane.

Figure 3:
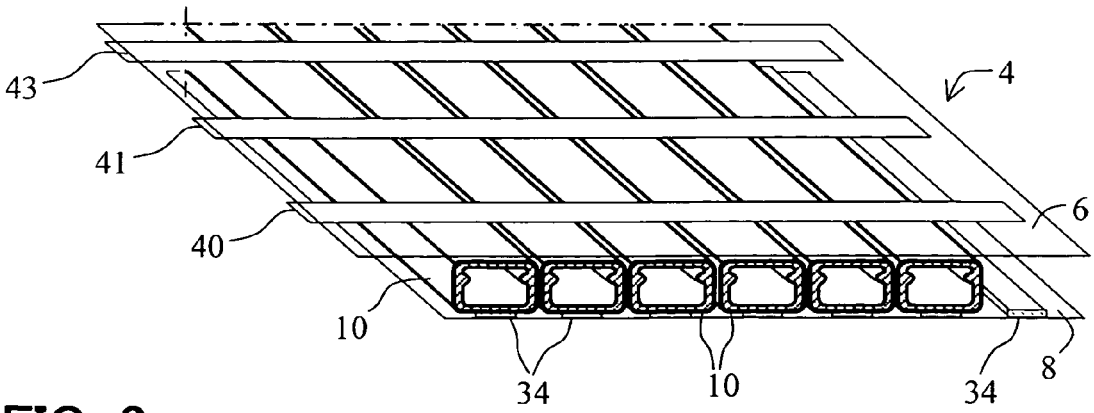
FIG. 3 shows a part of another example of an array of gas discharge tubes arranged to form a display device.

FIG. 3 shows a part of another example of an array of gas discharge tubes 10 arranged to form a display device 4. The gas discharge tubes 10 are disposed to extend side by side in parallel with each other. Similarly to the arrangement shown in FIG. 2, a pair of supports 6 and 8 facing each other are disposed to sandwich the gas discharge tube array, with the display surface 132 of the display device 4 contacting the support 6 and with the rear surface 134 contacting the support 8. A plurality of signal electrodes 34 are disposed, one for each gas discharge tube 10, to extend along the length direction of the gas discharge tubes 10, between and in contact with the rear surface 134 of the display device 4 and the inner surface of the support 8 facing the tubes 10. A plurality of main electrodes 40, 41 and 43 are disposed, at predetermined intervals, between the display surface 132 of the display device 4 and the support 6, to extend in the direction perpendicular to the direction in which the signal electrodes 34 extend. The spacing between adjacent ones of the main electrodes 40, 41 and 43 is sufficient to prevent discharge from occurring between them. The intersections of the signal electrodes 34 and the main electrodes 40, 41 and 43 provide unit light-emitting regions or cells.

In the arrangement shown in FIG. 3, when a predetermined voltage is applied between selected one of the main electrodes 40, 41 and 43 and selected one of the signal electrodes 34, a display discharge is generated at the intersection of the selected main electrode 40, 41 or 43 and the selected signal electrode 34, whereby display is provided. In this case, the display discharge is an opposite discharge generated within the internal space 18 of the gas discharge tube 10 between the selected main electrode 40, 41 or 43 and the selected signal electrode 34 facing the selected main electrode.

The signal electrodes 34 and the main electrodes 40-46 shown in FIGS. 2 and 3 are disposed to intimately contact the upper and lower surfaces of the gas discharge tubes 10 when the display devices 2 and 4 are assembled. An adhesive may be used to bond the electrodes to the surfaces of the display devices 2 and 4 so that the electrodes can intimately contact the display and rear surfaces.

The phosphor layer 22 is formed by applying a phosphor paste over the inner surface 124 of the thin tube 202 and the lower portions of the inner surfaces 126 and 128 and baking it. Such paste may be one of different types of pastes which are known to those skilled in the art. Referring to FIG. 2, when a high voltage is applied between the signal electrode 34 and the main electrode 40 and between the main electrodes 40 and 41, the discharge gas in the internal space 18 is excited, and the deexcitement process of the excited rare gas atoms produces vacuum ultraviolet light, which causes visible light to be emitted.

To fire the gas discharge tube 10, a high voltage is applied between the signal electrode 34 and the main electrode 40, and, then, a high voltage is applied between the main electrodes 40 and 42, which causes a minimal amount of charged particles to start moving. Without the ridges 14 and 16, the charged particles in such minimal amount can hardly reach the electron emissive coating 24 having a high secondary emission coefficient, and it is highly probable that such charged particles may be trapped by the discharge gas in the region of the internal space 18 near the main electrode 40, and may disappear. If the applied voltage is low, it is difficult for an electron density sufficient to fire, or start discharging, to be produced in the discharge space. As shown in FIG. 1, the ridges 14 and 16 are formed at mutually opposing locations near the inner surface 122, which is near to the main electrode, and the electron emissive coating 24 having a high secondary emission coefficient is formed to extend over the upper surfaces 142 and 162 of the ridges 14 and 16, too. This increases the possibility of the minimal amount of charged particles bombarding the electron emissive coating 24. Accordingly, the gas discharge tube 10 can be fired with a lower voltage than employed in prior art, e.g. a voltage lower by about 10 to 15 V than a conventionally employed firing voltage of 300 to 350 V.

Figure 4:
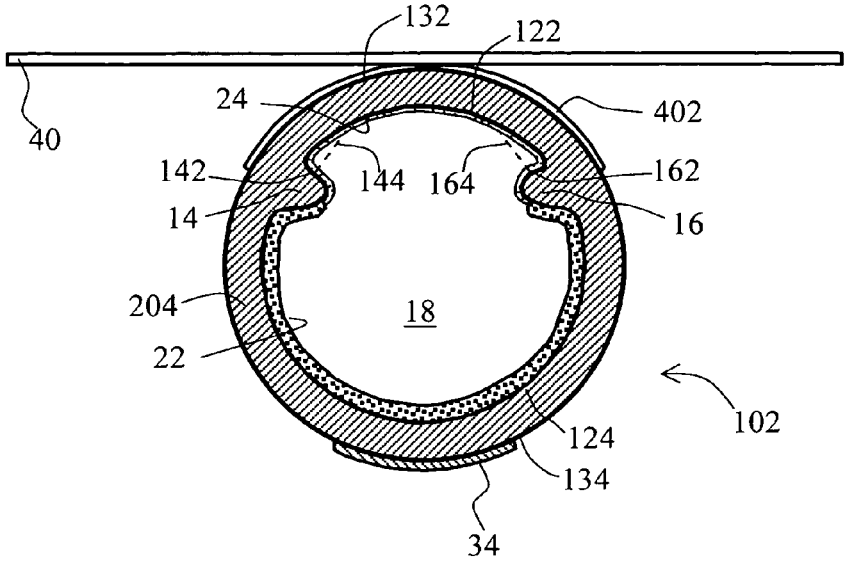
FIG. 4 shows a transverse cross-section of an elongated gas discharge tube for a display device according to another embodiment of the invention.

FIG. 4 shows a transverse cross-section of an elongated gas discharge tube 102 for a display device according to another embodiment of the invention. The gas discharge tube 102 includes an elongated, thin tube 204 of an insulating material. Typically, the thin tube 204 has an outer diameter of about 2 mm or less and a length of 300 mm or more, and its cross-section exhibits a generally circular shape. Alternatively, the tube 204 may have a generally elliptic or flattened-elliptic cross-section. A curved main electrode 402 connected to the main electrode 40 covers the upper outer surface 132 of the thin tube 204. The signal electrode 34 curves to cover the lower outer surface 134.

Figure 5:
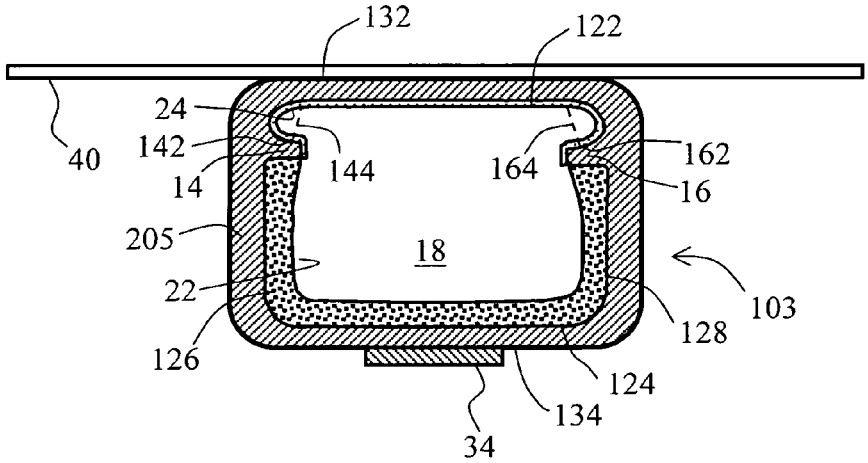
FIG. 5 shows a transverse cross-section of an elongated gas discharge tube for a display device according to still another embodiment of the invention.

FIG. 5 shows a transverse cross-section of an elongated gas discharge tube 103 for a display device according to still another embodiment of the invention. The gas discharge tube 103 includes an elongated, thin tube 205 of an insulating material, similarly to the tube 202 of FIG. 1. Each of the ridges 14 and 16 has a curved upper surface sloping downward toward the opposing inner tube surface, and a flat lower surface. The remainder of the tube 206 is the same as the tube 202 of FIG. 1.

Figure 6:
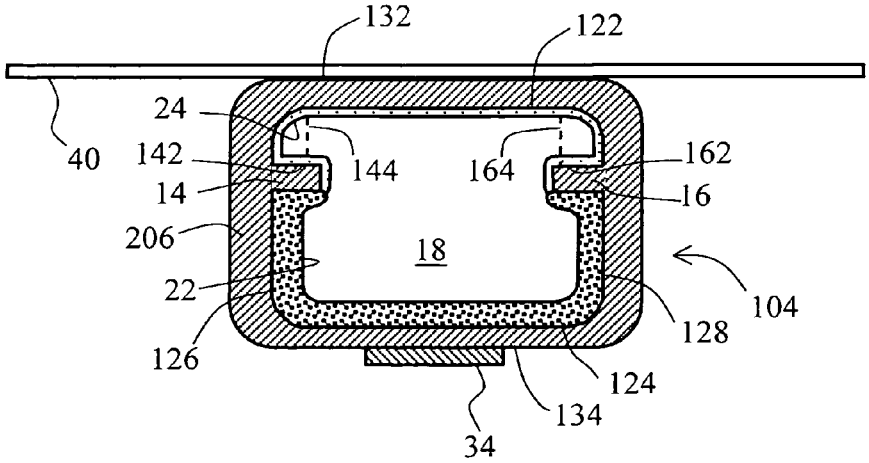
FIG. 6 shows a transverse cross-section of an elongated gas discharge tube for a display device according to a further embodiment of the invention.

FIG. 6 shows a transverse cross-section of an elongated gas discharge tube 104 for a display device according to a further embodiment of the invention. The gas discharge tube 104 includes an elongated, thin tube 206 of an insulating material. The cross-section of the ridges 14 and 16 is rectangular. The remainder is the same as the tube 202 of FIG. 1.

Figure 7:
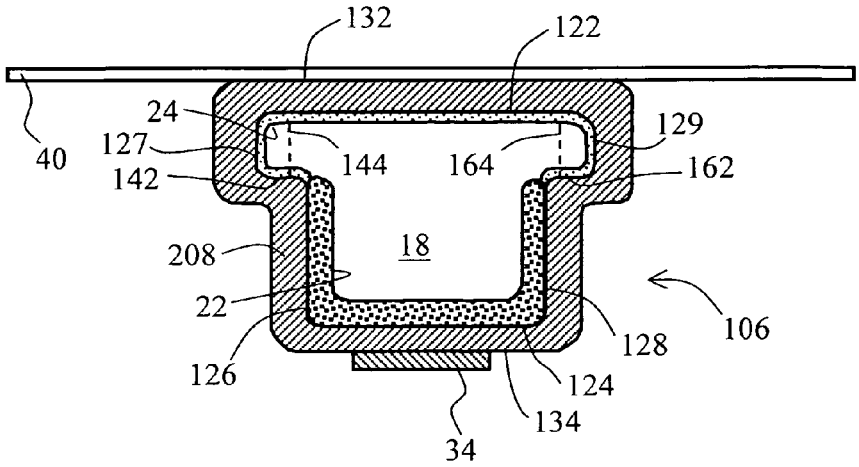
FIG. 7 shows a transverse cross-section of an elongated gas discharge tube for a display device according to a still further embodiment of the invention.

FIG. 7 shows a transverse cross-section of an elongated gas discharge tube 106 for a display device according to a still further embodiment of the invention. The gas discharge tube 106 includes an elongated, thin tube 208 of a transparent insulating material. The thin tube 208 includes no ridges like the ones 14 and 16 shown in FIG. 1. Instead, the cross section of the thin tube 208 is such that the internal space 18 of the tube 208 consists of two vertically stacked rectangular portions. The rectangular shape of the cross-section of the lower portion of the space 18 is similar to the shape of the cross-section of the thin tube 206 shown in FIG. 6. The upper rectangular portion has a smaller height and larger width than the lower portion. The phosphor layer 22 is formed over the lower inner surfaces 124, 126 and 128 of the tube 208. The electron emissive coating 24 is formed to extend over the inner surfaces 142, 127, 122, 129 and 162 of the upper portion of the tube 208. As indicated by broken lines in FIG. 7 as well as in FIG. 6, the inner surfaces 142 and 162 are formed in such a manner that the normals to the respective surfaces intersect the upper inner surface 122.

Figure 8:
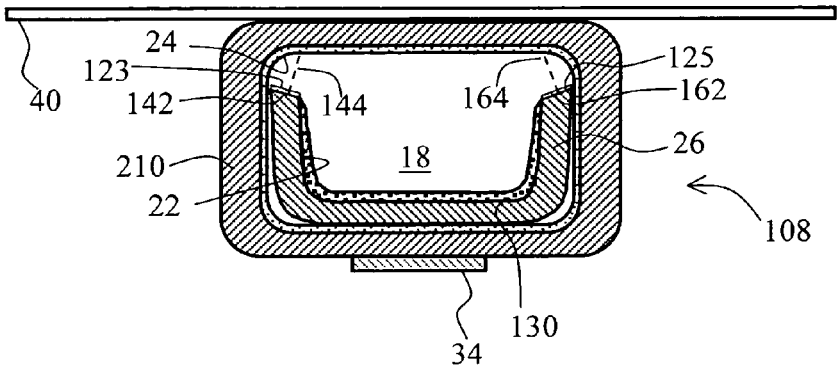
FIG. 8 shows a transverse cross-section of an elongated gas discharge tube for a display device according to a different embodiment of the invention.

FIG. 8 shows a transverse cross-section of an elongated gas discharge tube 108 for a display device according to a different embodiment of the invention. The gas discharge tube 108 includes an elongated, thin tube 210 of a transparent insulating material, as the thin tubes described hereinbefore. The thin tube 210 has a rectangular cross-section like the one of the thin tube 202 of the gas discharge tube 10, but includes no ridges. Instead, an elongated support member or trough 26, having a generally U-shaped transverse cross-section, is placed in the internal space 18 of the thin tube 210. The inward facing upper surface 130 of the support member 26 is coated with the phosphor layer 22. The trough 26 has two upward facing end surfaces 142 and 162 at the distal ends of the respective legs, and electron emissive coatings 123 and 125 are formed on the end surfaces 142 and 162, respectively. The electron emissive coating 24 is also formed on the inner surfaces of the thin tube 210.

The support member 26 is formed of a transparent insulating material, for example, borosilicate glass, and is formed as a member separate from the thin tube 210. Before placing the support member 26 into the thin tube 210, a phosphor paste is applied over the inward facing surface 130 of the support member 26 and then baked to form the phosphor layer 22.

Figure 9:
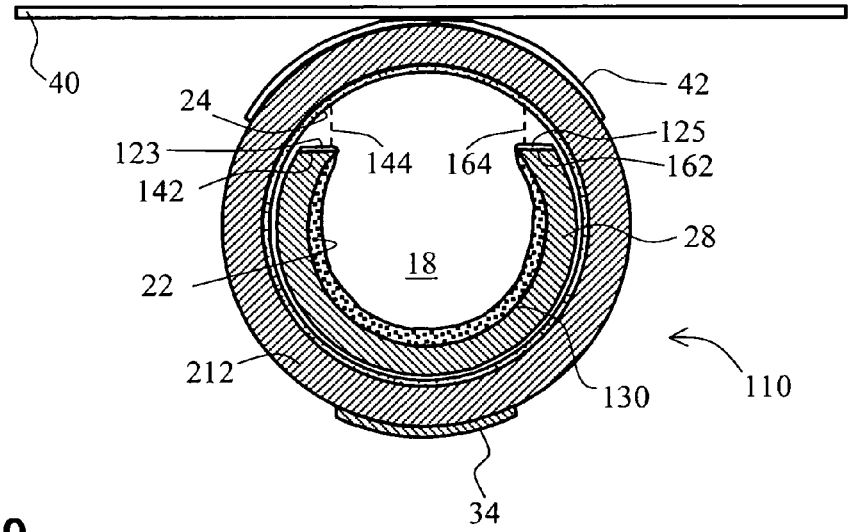
FIG. 9 shows a transverse cross-section of an elongated gas discharge tube for a display device according to a further different embodiment of the invention.

FIG. 9 shows a transverse cross-section of an elongated gas discharge tube 110 for a display device according to a further different embodiment of the invention. The discharge tube 110 is a modification of the discharge tube 108 of FIG. 8. The gas discharge tube 110 includes a thin tube 212 having a generally circular cross-section similar to the thin tube 204 shown in FIG. 4, but does not have the ridges 14 and 16. Instead, an elongated support member or trough 28 having a generally C-shaped transverse cross-section is inserted into the internal space 18 of the thin tube 212. The phosphor layer 22 is formed on the inward facing upper surface 130 of the support member 28. The support member 28 has upward facing end surfaces 142 and 162, which are coated with electron emissive coatings 123 and 125, respectively. The electron emissive coating 24 is also formed on the inner surface of the thin tube 212.

Figure 10:
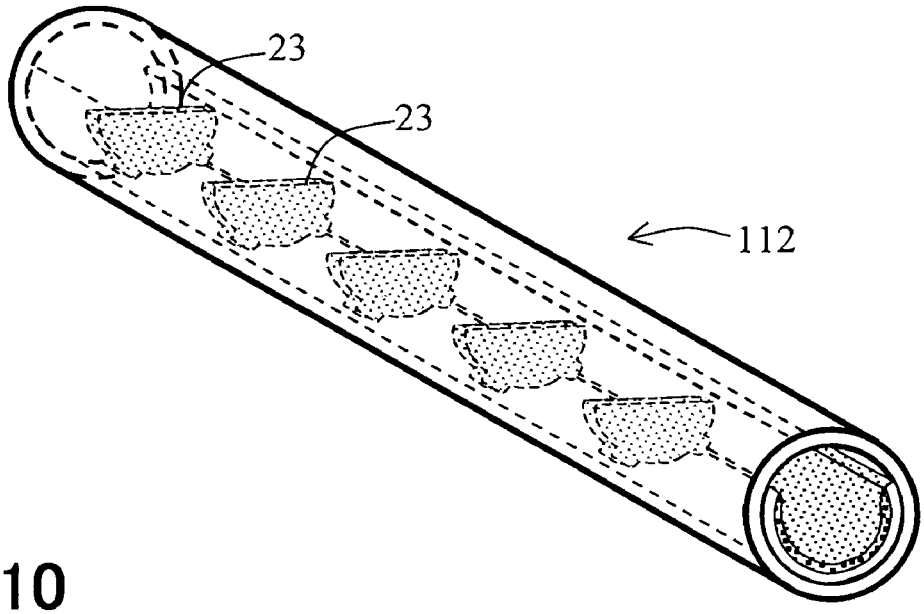
FIG. 10 is a perspective view of an elongated gas discharge tube for a display device in accordance with a still further embodiment of the invention.
Figure 11A:
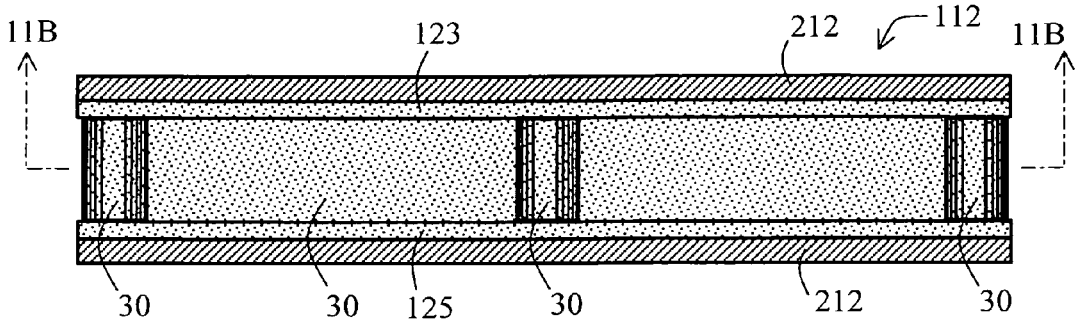
FIG. 11A is a longitudinal cross-sectional view of the gas discharge tube shown in FIG. 10, along the line 11A-11A shown in FIGS. 11B and 11C.
Figure 11B:
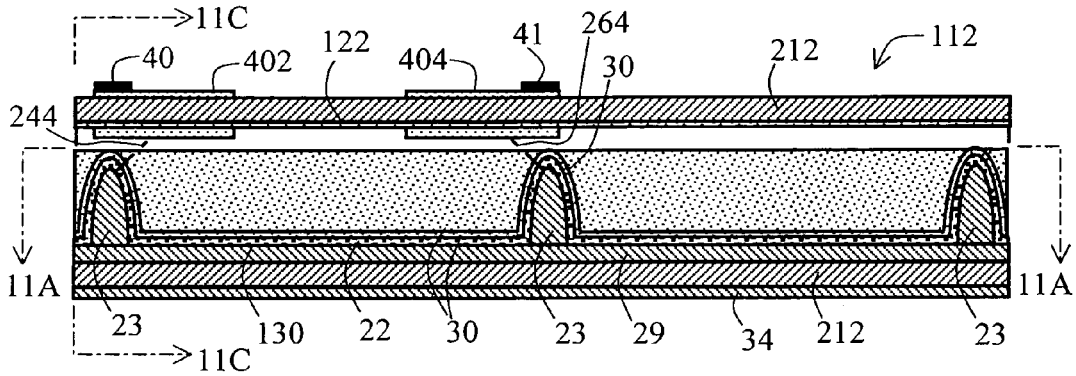
FIG. 11B is a longitudinal cross-sectional view along the line 11B-11B in FIG. 11A.
Figure 11C:
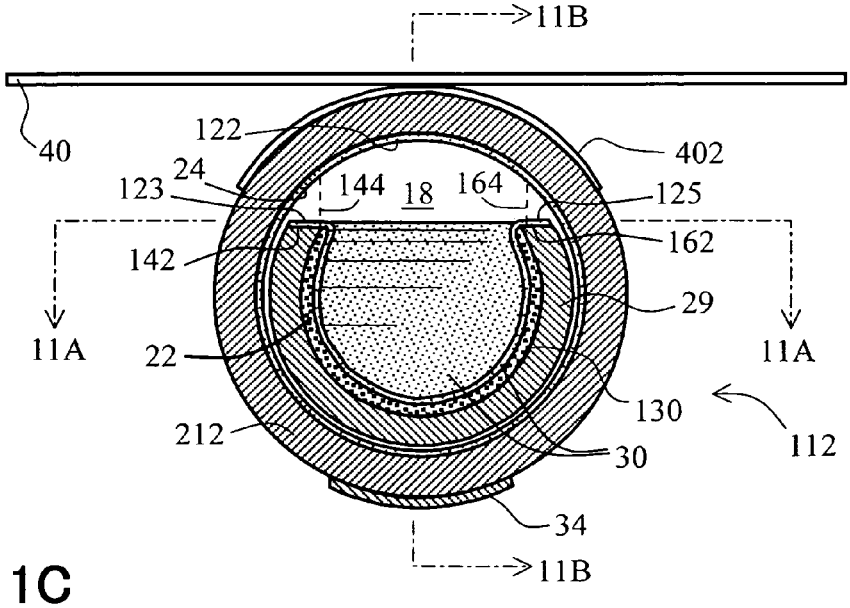
FIG. 11C is a transverse cross-sectional view along the line 11C-11C in FIG. 11B.

FIG. 10 is a perspective view of an elongated gas discharge tube 112 for a display device in accordance with a still further embodiment of the invention. FIGS. 11A, 11B and 11C show cross-sections of the gas discharge tube 112 observed at different locations. The gas discharge tube 112 includes a support member 29 disposed in the thin tube 212. The support member 29 is similar to the support member 28 shown in FIG. 9, but it is additionally provided with partitions, banks or partitioning members 23, whose surfaces are coated with a phosphor layer.

FIG. 11A is a longitudinal cross-sectional view of the gas discharge tube 112 shown in FIG. 10, along the line 11A-11A shown in FIGS. 11B and 11C, FIG. 11B is a longitudinal cross-sectional view along the line 11B-11B in FIG. 11A, and FIG. 11C is a transverse cross-sectional view along the line 11C-11C in FIG. 11B.

A plurality of partitions 23 project upward from the trough 29 at intervals along the longitudinal direction of the support member 29 to partition the inward facing upper surface of the support member 29 into light-emitting regions for respective pixels. The material of the partitions 23 may be the same as the one of the support member 29. The phosphor layer 22 is also formed on the upward projecting partitions 23 so that the area of the phosphor layer for each light-emitting region increases. The partitions 23 also function to prevent leakage of light into adjacent light-emitting regions, so that the vacuum ultraviolet light generated in the discharge space can be utilized effectively. The provision of the partitions 23 increases the mechanical strength of the support member 29. In FIG. 11B, three electrodes are provided for each light-emitting region, but the present invention is not limited to such three-electrode arrangement. Instead, an arrangement using two electrodes for each light-emitting region may be employed.

The electron emissive coatings 24, 30, 123 and 125 are formed on the inner surface 122 of the thin tube 212 and the end surfaces 142 and 162 of the support member 29, respectively. The partitions 23 are formed in such a manner that the normal 244 (264) to the surface portion of each partition 23 facing to the main electrode 40 intersects the upper inner surface 122 of the tube 212 or the curved main electrode 402 (404). The presence of the electron emissive coating 30 on the portions of the partition 23 facing to the main electrode 40, and the electron emissive coatings 123 and 125 on the end surfaces 142 and 162 of the support member 29 reduces the firing voltage.

Figure 12:
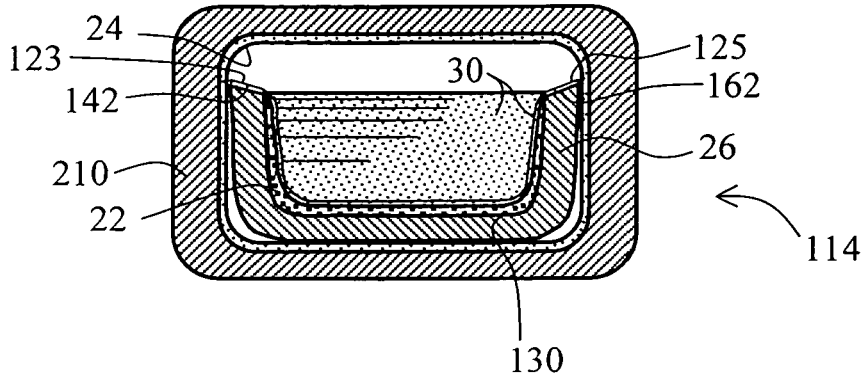
FIG. 12 is a transverse cross-sectional view of an elongated gas discharge tube for a display device in accordance with a further different embodiment of the invention.

FIG. 12 is a transverse cross-sectional view of an elongated gas discharge tube 114 for a display device in accordance with a further different embodiment of the invention. The longitudinal cross-section in a horizontal plane passing through the tube 113 is similar to the cross-section of the discharge tube 112 shown in FIG. 11A, and the longitudinal cross-section in a vertical plane passing through the tube 114 is similar to the cross-section shown in FIG. 11B. The gas discharge tube 114 has a thin tube 210 like the one 210 shown in FIG. 8 in which a support member 26 similar to the one 26 shown in FIG. 8 is disposed. Partitions 23 similar to the ones 23 of the gas discharge tube 112 shown in FIGS. 10, 11A, 11B and 11C project from the support member 26, and the phosphor layer 22 is disposed on the surface of each partition 23. The electron emissive coating 30 is disposed over the phosphor layer 22.

Figure 13:
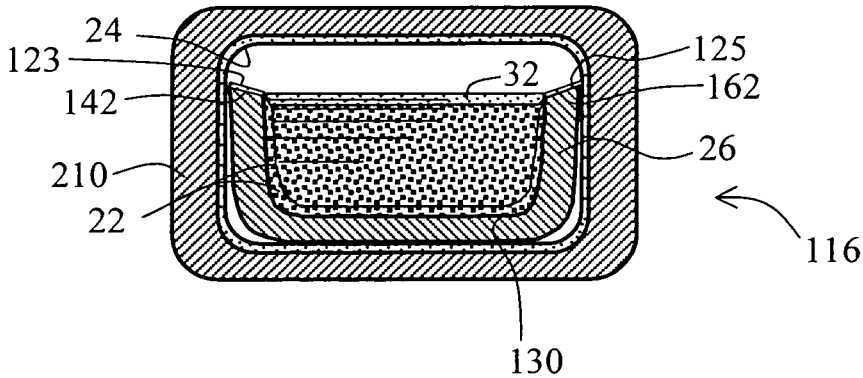
FIG. 13 is a transverse cross-sectional view of an elongated gas discharge tube for a display device in accordance with a still further embodiment of the invention, which is a modification of the embodiment of FIG. 12.

FIG. 13 is a transverse cross-sectional view of an elongated gas discharge tube 116 for a display device in accordance with a still further embodiment of the invention. The tube 116 is a modification of the gas discharge tube 114 shown in FIG. 12. The gas discharge tube 116 includes the electron emissive coatings 123 and 125 on the upward facing end surfaces 142 and 162 of the support member 26, and the electron emissive coating 30 on the top portion of the phosphor layer 22 formed on each partition 23, but an electron emissive coating is disposed neither on the phosphor layer 22 on the side surfaces of each partition 23 nor on the upward facing inner surface of the support member 26.

FIGS. 14A through 14E illustrate a process for manufacturing the gas discharge tube 10 shown in FIG. 1. As shown in FIG. 14A, two glass rods 314 and 316 having a diameter of 2 mm are fused to inner surfaces of shorter sides of a glass tube 332 having a rectangular cross-section, of which outer dimensions are 20 mm×10 mm, to thereby form two ridges 414 and 416 as shown in FIG. 14B. Then, as shown in FIG. 14C, the glass tube 332 is redrawn into a glass thin tube 206 whose cross-sectional dimensions are 1 mm×0.5 mm. A liquid containing magnesium stearate is applied over the inner surface of the glass thin tube 206 and dried, to form a magnesium stearate coating 24 over the inner surface including the ridges 414 and 416, as shown in FIG. 14D. Then, a phosphor slurry is introduced into the thin glass tube 206 in such a manner that the phosphor layer 22 can be formed over the lower portion of the inner surface of the thin glass tube 206 as shown in FIG. 14E. Then, the thin glass tube 206 is baked at a maximum temperature of 500° C. After that, a discharge gas consisting of neon (Ne) and xenon (Xe) is introduced into the thin glass tube 206 to a partial pressure of 350 Torr, and the two ends of the glass tube 206 are fused to seal the tube 206, which completes the gas discharge tube 10 shown in FIG. 1.

Figure 15A:
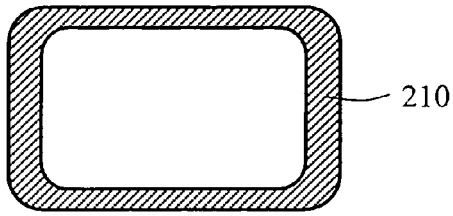
FIGS. 15A through 15F illustrate a process for manufacturing the gas discharge tube shown in FIG. 8.
Figure 15B:
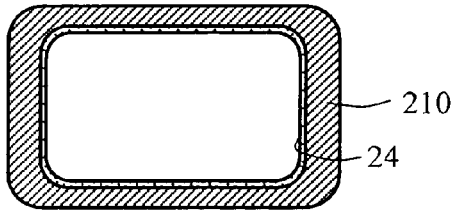
Figure 15C:
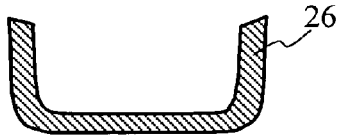
Figure 15D:
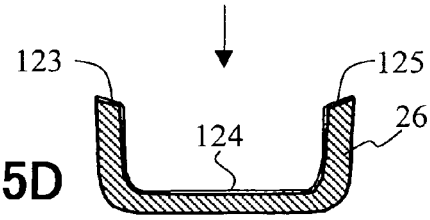
Figure 15E:
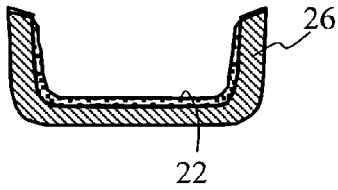
Figure 15F:
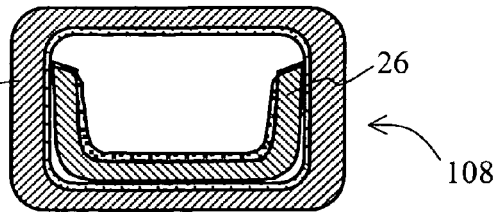

FIGS. 15A through 15F illustrate a process for manufacturing the gas discharge tube 108 shown in FIG. 8. By redrawing a glass tube having a rectangular transverse cross-section in the manner similar to the one shown in FIG. 14C, a glass thin tube 210 having cross-sectional dimensions of 1 mm×0.5 mm like the one shown in FIG. 15A is obtained. Then, as shown in FIG. 15B, a magnesium oxide (MgO) coating 24 is vapor deposited over the inner surface of the thin glass tube 210. By redrawing a glass member having a U-shaped cross-section, a support member or trough 26 is made. Next, magnesium oxide (MgO) coatings 123, 124 and 125 are vapor deposited on surfaces of the support member 26, as shown in FIG. 15D. A phosphor paste is applied over the upward facing inner surface of the support member 26 and, then, baked at a highest temperature of 480° C. This results in the support member 26 having the magnesium oxide (MgO) coatings 123 and 125 on the end surfaces of the support member 26, and the phosphor layer 22 on the upward facing inner surface of the support member 26, as shown in FIG. 15E. After that, the support member 26 is inserted into the thin glass tube 210, as shown in FIG. 15F, and, then, a discharge gas consisting of neon (Ne) and xenon (Xe) is introduced into the thin glass tube 210 to a partial pressure of 350 Torr. After that, the opposite ends of the thin glass tube 210 are fused for sealing. This completes the gas discharge tube 108 shown in FIG. 8.

Figure 16:
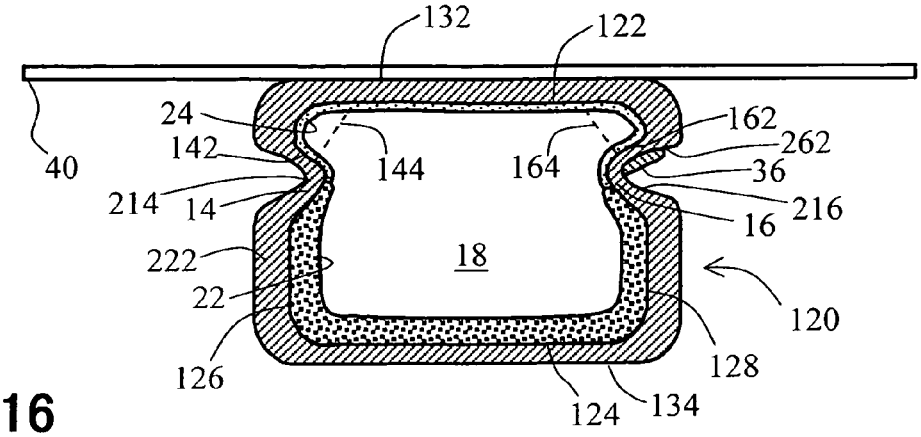
FIG. 16 shows a transverse cross-sectional view of an elongated gas discharge tube in accordance with another embodiment of the invention.

FIG. 16 shows a transverse cross-sectional view of an elongated gas discharge tube 120 in accordance with another embodiment of the invention. The gas discharge tube 120 includes a thin tube 222. Different from the gas discharge tubes described hereinbefore, no signal electrodes 34 are used with this gas discharge tube 120. Instead, grooves 214 and 216 generally conformable with the ridges 14 and 16 are formed in the outer surface of the thin glass tube 214 at the locations corresponding to the ridges 14 and 16, respectively. A signal electrode 36 in the form of a thin film is disposed on a wall portion 262 of the groove 216 at a location corresponding to that of the upward facing inner surface portion 162. No signal electrode is disposed on the rear surface 134 of the gas discharge tube 120. The remainder of the gas discharge tube 120 is the same as the tube 10 shown in FIG. 1.

Figure 17:
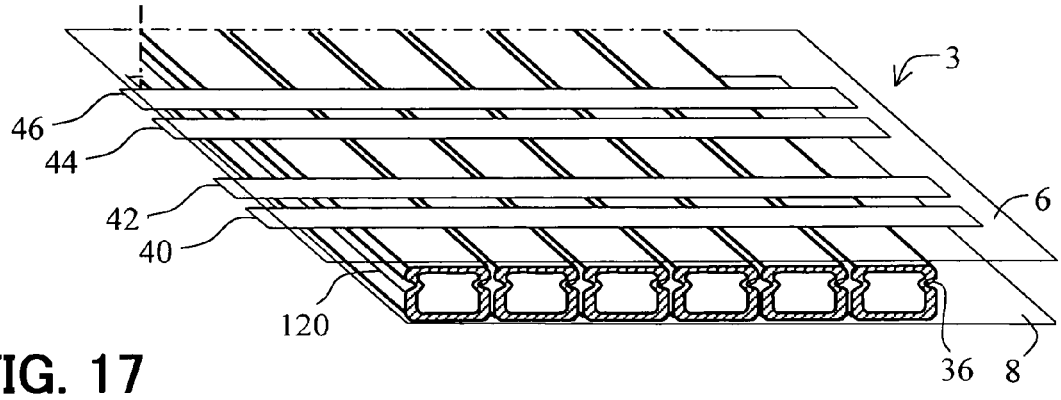
FIG. 17 shows a portion of an array of a plurality of gas discharge tubes shown in FIG. 16 arranged in parallel to form a display device.

FIG. 17 shows a portion of an array of a plurality of gas discharge tubes 120 shown in FIG. 16 arranged in parallel to form a display device 3. As shown, a pair of supports 6 and 8 are disposed on the display surface 132 and the rear surface 134, respectively, to sandwich the gas discharge tube array therebetween, and a pair of display electrodes 40 and 42 and a pair of display electrodes 44 and 46, for applying a voltage to the gas discharge tube 120, are formed on the surface of the support 6 facing the display surface 132 of the array of gas discharge tubes 120. As described above, no signal electrodes are disposed between the rear surface 134 of the gas discharge tubes 120 and the support 8. In other words, the support 8 is disposed on the rear surface 134 of the display device 3 with no signal electrodes interposed between them. The remainder of the arrangement shown in FIG. 17 is the same as the arrangement shown in FIG. 2.

The above-described embodiments are only typical examples, and their combination, modifications and variations are apparent to those skilled in the art. It should be noted that those skilled in the art can make various modifications to the above-described embodiments without departing from the principle of the invention and the accompanying claims.

What is claimed is:

1. A gas discharge tube comprising a thin tube having a discharge space therein and an electron emissive coating formed within said thin tube, said thin tube having a display surface on which a pair of display electrodes is adapted to be disposed, and having a rear surface on which a signal electrode is adapted to be disposed, wherein a surface portion facing toward said display surface is formed within said thin tube at a location nearer to said display surface from the midway between said display and rear surfaces, and an electron emissive coating is formed on said surface portion.

2. The gas discharge tube according to claim 1 wherein there are provided a plurality of such surface portions, said surface portions being formed to extend in the longitudinal direction of said thin tube, end the locations and number of said surface portions are determined in such a manner that said thin tube exhibits bilateral symmetry.

3. The gas discharge tube according to claim 1 wherein said thin tube has a generally rectangular, circular or flattened-elliptical cross-section.

4. The gas discharge tube according to claim 1 wherein said surface portion being formed to extend in the longitudinal direction of said thin tube.

5. A display device comprising a gas discharge tube array including a plurality of gas discharge tubes according to claim 1 arranged in parallel side by side, and a pair of suppotts respectively disposed on a display surface side and a rear surface side of said gas discharge tube array to sandwich said gas discharge tube array, one of said supports bearing a plurality of such pairs of display electrodes on a surface of said one support that faces said gas discharge tube array, the other one of said supports bearing a plurality of such signal electrodes on a surface of said other support that faces said gas discharge tube array.

6. A gas discharge tube comprising a thin tube having a discharge space therein and an electron emissive coating formed within said thin tube, said thin tube having a display surface on which a pair of display electrodes is adapted to be disposed, and having a rear surface on which a signal electrode is adapted to be disposed, wherein a protrusion is formed to protrude from a portion of an inner wall of said thin tube toward said discharge space, said protrusion having a surface portion facing toward said display surface; and an electron emissive coating is formed on said surface portion.

7. A display device comprising a gas discharge tube array including a plurality of gas discharge tubes according to claim 6 arranged in parallel side by side, and a pair of supports respectively disposed on a display surface side and a rear surface side of said gas discharge tube array to sandwich said gas discharge tube array, one of said supports bearing a plurality of such pairs of display electrodes on a surface of said one support that faces said gas discharge tube array, the other one of said supports bearing a plurality of such signal electrodes on a surface of said other support that faces said gas discharge tube array.

8. A gas discharge tube comprising a thin tube having a discharge space therein and an electron emissive coating formed within said thin tube, said thin tube having a display surface on which a pair of display electrodes is adapted to be disposed, wherein said thin tube has a protrusion protruding from a portion of an inner wall of said thin tube toward said discharge space and having a surface portion facing toward said display surface, and has a groove formed in an outer surface of said thin tube and generally conformable with said protrusion;

an electron emissive coating is formed on said surface portion; and a signal electrode is adapted to be formed on a surface portion of said groove corresponding to said surface portion of said protrusion.

9. A display device comprising a gas discharge tube array including a plurality of gas discharge tubes according to claim 8 arranged in parallel side by side, and a pair of supports respectively disposed on a display surface side and a rear surface side of said gas discharge tube array to sandwich said gas discharge tube array, one of said supports bearing a plurality of such pairs of display electrodes on a surface of said one support that faces said gas discharge tube array.

10. A gas discharge tube comprising a thin tube having a discharge space therein, and an electron emissive coating and a phosphor layer disposed within said thin tube, said thin tube having a display surface on which a pair of display electrodes is adapted to be disposed, and having a rear surface on which a signal electrode is adapted to be disposed, wherein said phosphor layer is formed on a support member separate from said thin tube, said support member being inserted into said thin tube to locate in said discharge space, said support member having an end surface facing toward said display surface of said thin tube, an electron emissive coating being formed on said end surface of said support member.

11. The gas discharge tube according to claim 10 wherein said support member has a plurality of partitions disposed at intervals along the length of said support member partitioning said discharge space into a plurality of internal discharge regions defined by said electrodes, an electron emissive coating is formed on at least part of a surface of each partition located near to said electrodes.

12. The gas discharge tube according to claim 11 wherein a phosphor layer is formed on said surfaces of said partitions, end an electron emissive coating is formed on said phosphor layer on said partitions.

13. The gas discharge tube according to claim 10 wherein an electron emissive coating is formed on said phosphor layer.

14. A display device comprising a gas discharge tube array including a plurality of gas discharge tubes according to claim 10 arranged in parallel side by side, and a pair of supports respectively disposed on a display surface side and a rear surface side of said gas discharge tube array to sandwich said gas discharge tube array, one of said supports bearing a plurality of such pairs of display electrodes on a surface of said one support that faces said gas discharge tube array, the other one of said supports bearing a plurality of such signal electrodes on a surface of said other support that faces said gas discharge tube array.

* * * * *

UNITED STATES PATENT AND TRADEMARK OFFICE

CERTIFICATE OF CORRECTION

PATENT NO. : 7,339,312 B2
APPLICATION NO. : 11/064950
DATED : March 4, 2008
INVENTOR(S) : Hitoshi Yamada et al.

It is certified that error appears in the above-identified patent and that said Letters Patent is hereby corrected as shown below:

First Page, Column 1 (Title), Line 3, after “TOWARDS” insert --A--.

Column 1 (Title), Line 3, after “TOWARDS” insert --A--.

Column 11, Line 20, change “end” to --and--.

Column 11, Line 32, change “suppotts” to --supports--.

Column 12, Line 44, change “end” to --and--.

Signed and Sealed this

Nineteenth Day of August, 2008

JON W. DUDAS
*Director of the United States Patent and Trademark Office*